US005383830A

United States Patent [19]

Shu

[11] Patent Number: 5,383,830

[45] Date of Patent: Jan. 24, 1995

[54] ADJUSTABLE AIR PRESSURE FORCE RESISTANCE EXERCISER SYSTEM

[75] Inventor: Long-Chuan Shu, Tainan Hsien, Taiwan, Prov. of China

[73] Assignee: Shuang Rong Shing Traffic Material Factory Co., Ltd., Tainan Hsien, Taiwan, Prov. of China

[21] Appl. No.: 200,448

[22] Filed: Feb. 23, 1994

[51] Int. Cl.[6] ..... A63B 69/16

[52] U.S. Cl. ..... 482/63; 482/57; 482/112

[58] Field of Search ..... 482/57, 59, 58, 111, 482/112, 113, 63, 148, 51

[56] References Cited

U.S. PATENT DOCUMENTS

| | | | |
|---|---|---|---|
| 681,565 | 8/1901 | McCune | 482/59 |
| 4,082,264 | 4/1978 | Santos | 482/59 |
| 4,509,742 | 4/1985 | Cones | 482/58 |
| 4,917,376 | 4/1990 | Lo | 482/59 |
| 5,125,879 | 6/1992 | Kuo | 482/111 |

FOREIGN PATENT DOCUMENTS

| | | | |
|---|---|---|---|
| 0312207 | 4/1989 | European Pat. Off. | 482/59 |

*Primary Examiner*—Stephen R. Crow

*Attorney, Agent, or Firm*—Morton J. Rosenberg; David I. Klein

[57] ABSTRACT

An adjustable pressurized air in a wheel box for exerciser includes a wheel being rotatably sealed in a box which is filled with air to a predetermined pressure through a check valve. The pressure is measured by a pressure gauge which will release extra pressure through another check valve to maintain a constant and most ,appropriate pressure in the box which will produce resistance to rotate the wheel by stepping on a pair of pedals of a training bicycle to rotate the wheel.

1 Claim, 5 Drawing Sheets

ADJUSTABLE AIR PRESSURE FORCE RESISTANCE EXERCISER SYSTEM

FIELD OF THE INVENTION

This invention relates to an exerciser, and more particularly, to an exerciser having an adjustable force resistance responsive to a predetermined air pressure contained in a wheel box mounted on the exerciser.

BACKGROUND OF THE INVENTION

Indoor exercise has become more popular in recent times for a variety of reasons including external environment air pollution and for security reasons. The subject invention includes a stationary bicycle.

Stationary bicycles presently on market may be divided into three categories: (1) blade rotation for producing force resistance; (2) magnetic field to produce force resistance with respect to the rotation of a wheel; and, (3) friction to produce necessary force resistance.

However, the aforementioned bicycles are noisy during operation and in the case of the friction type exerciser, it is difficult to adjust the proper friction force setting.

SUMMARY OF THE INVENTION

It is the primary object of the present invention to provide an adjustable air pressure force resistance exerciser within a wheel box for a user where the pressure is easily adjusted to accommodate exercisers having different force resistance needs.

It is another object of the present invention to provide an adjustable air pressure force resistance exerciser which is operationally quiet.

It is a further object of the present invention to provide an adjustable air pressure force resistance exerciser which is suitable for a wide range of people of all ages and sexes having differing force resistance needs.

DETAILED DESCRIPTION OF THE PREFERRED EMBODIMENT

Figure 1:
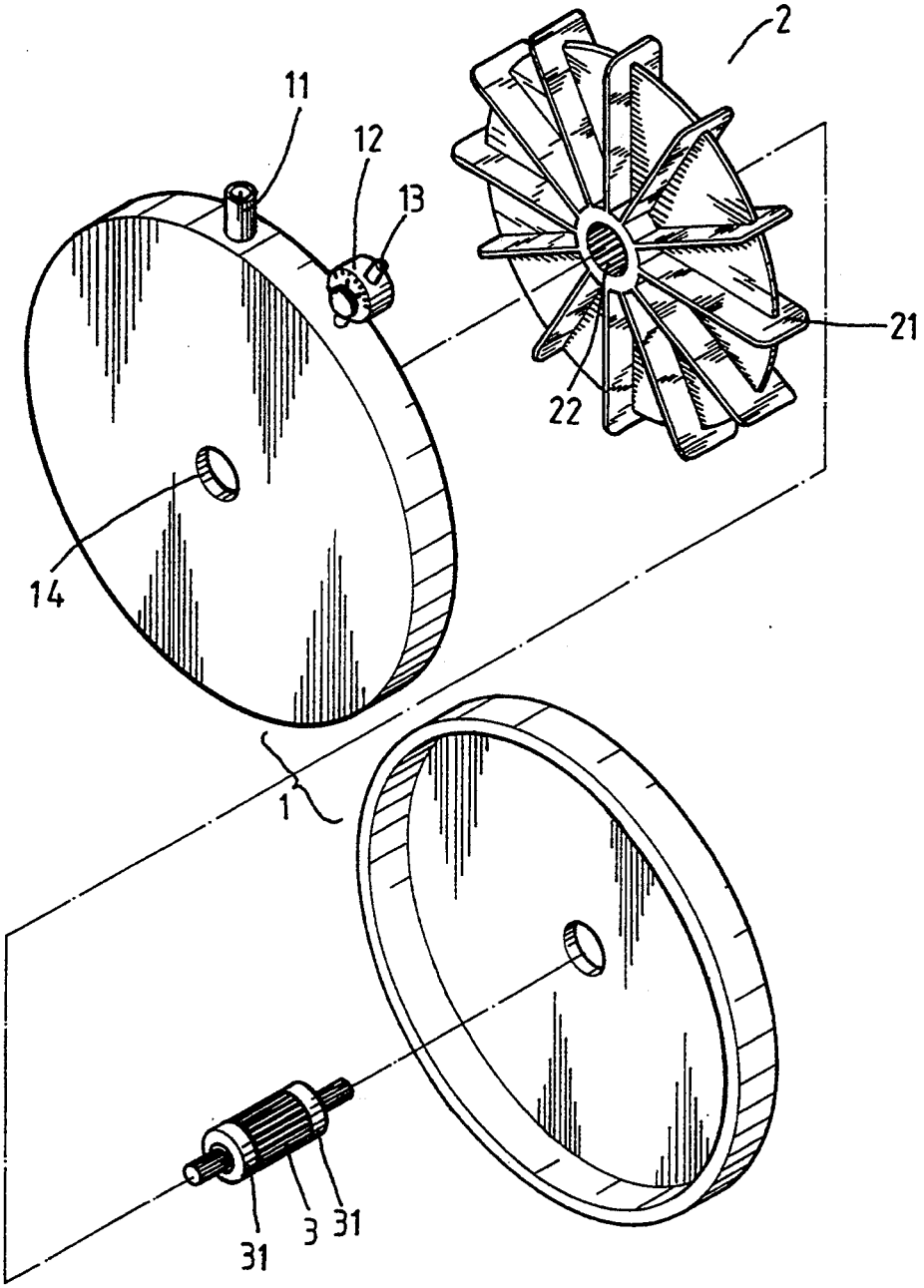
FIG. 1 is an exploded view of a wheel box showing the subject invention concept.
Figure 2:
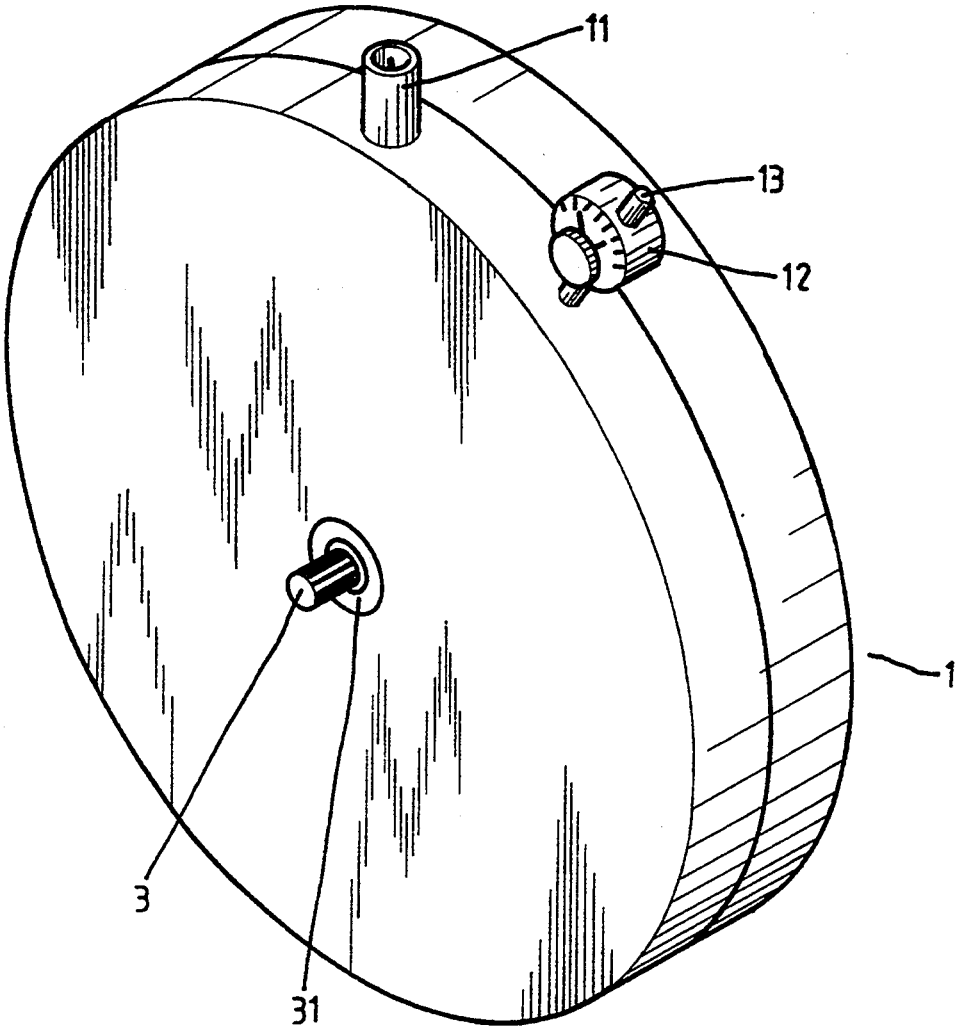
FIG. 2 is a perspective view of the wheel box.
Figure 3:
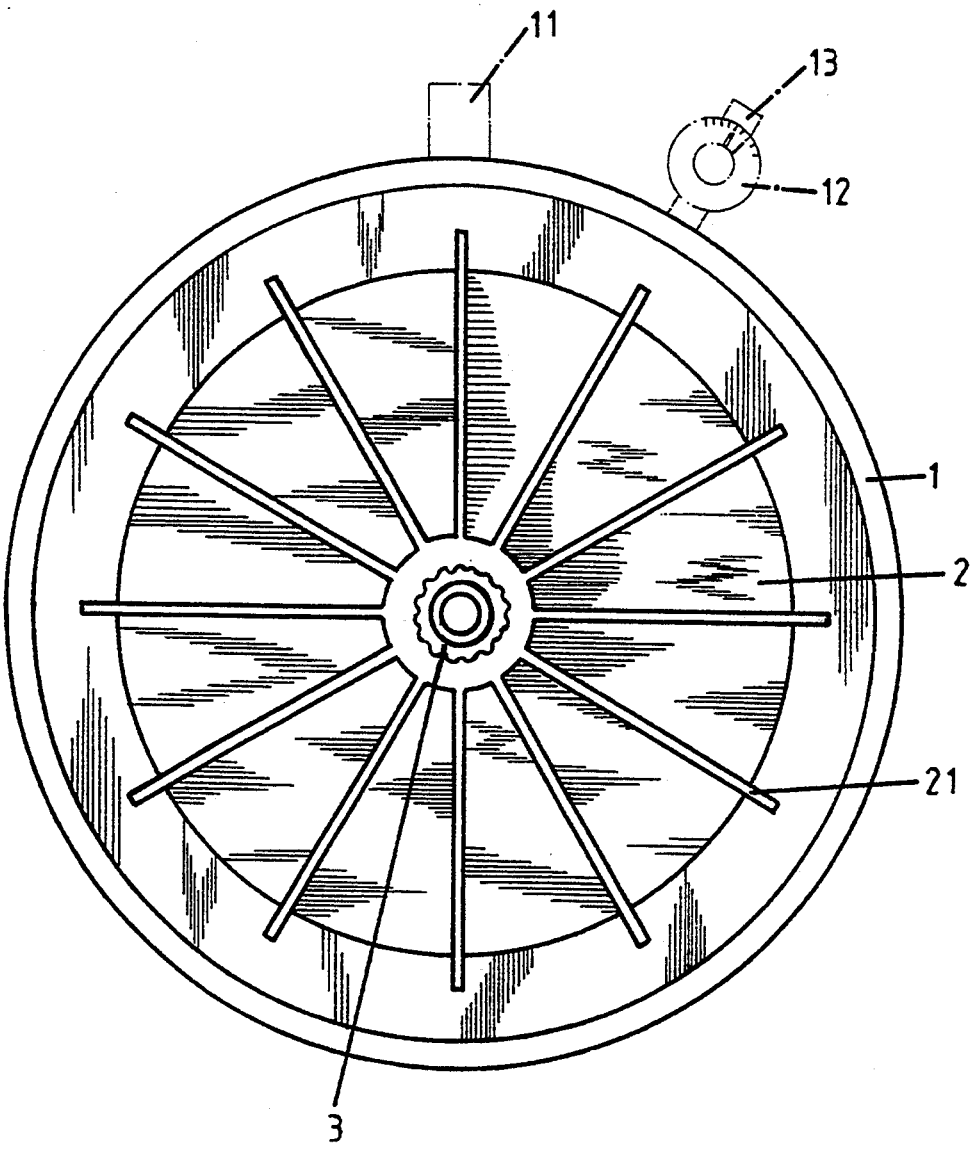
FIG. 3 is a side sectional view of FIG. 2.

Referring now to FIGS. 1–5, there is shown a controlled and adjustable resistance force exercise system where the drawings are for the purpose of illustrating a preferred embodiment of the present invention and not for the purpose of limiting the scope of the invention concept. FIGS. 1–3 illustrate a pressurized air wheel box essentially composed of a disk shaped hollow box 1 having a wheel 2 rotatably mounted within and with respect to the box 1.

The box 1 includes a check valve 11 mounted in a sidewall thereof and adapted to provide for air to be pumped internal the box 1. A check valve 13 is similarly mounted in the sidewall of the box 1 for allowing egress of air when pressure gauge 12 reaches a predetermined value of air pressure in the box 1. An axially directed aperture 14 passes through box 1 as shown.

The wheel 2 includes a plurality of radially extending blades 21 formed thereon with the blades 21 being angularly equally spaced from each other. A through aperture 22 is formed through the center of wheel 2 and is adapted to receive an axle 3 inserted therethrough. The respective ends of the axle 3 then are mounted within the aperture 14 by means of the bearing 31 at respective sides thereof for seating of the axle 3 in the apertures 14 of the box 1.

Figure 4:
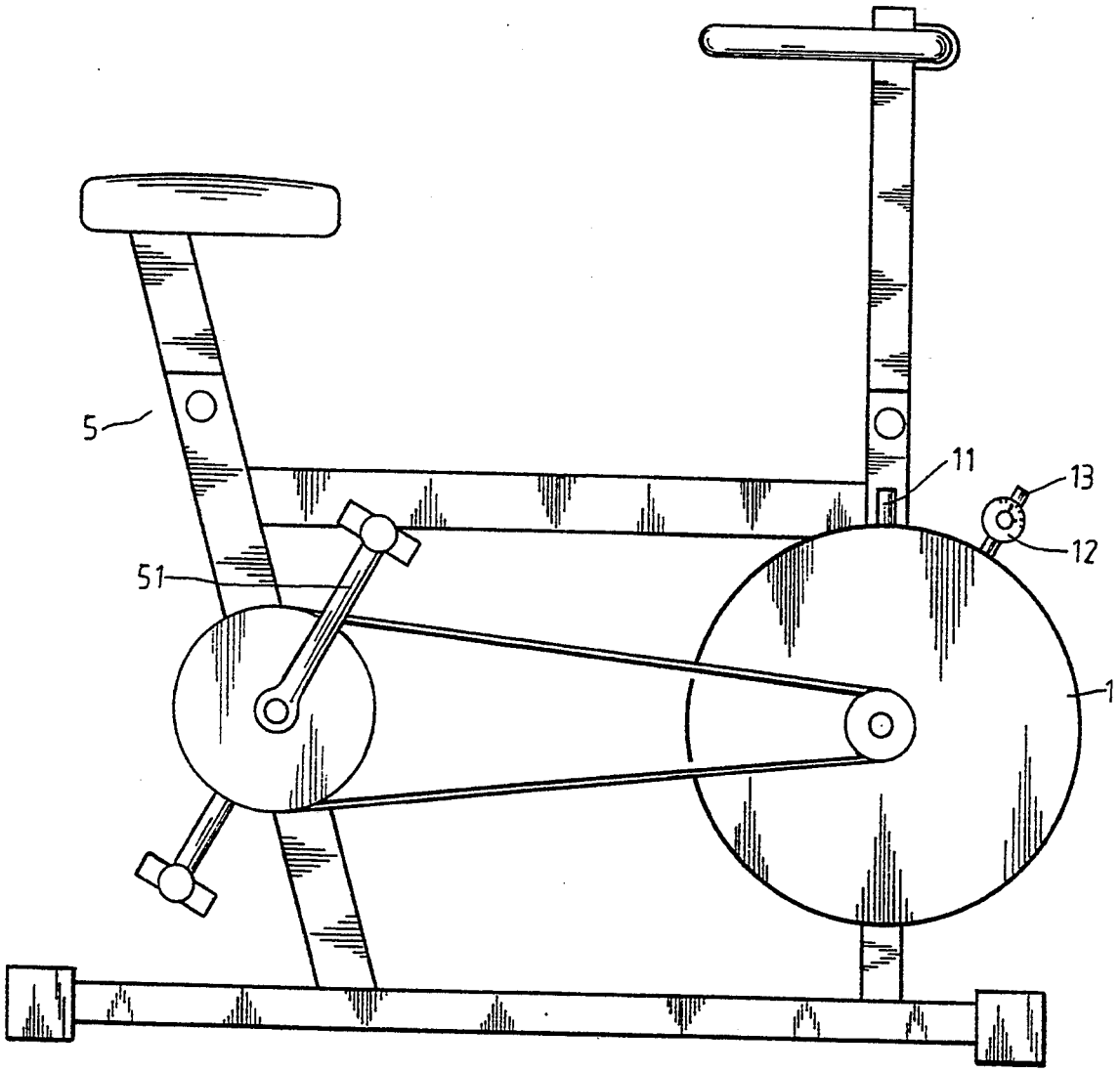
FIG. 4 is a side elevational view showing an adjustable pressurized air wheel box mounted on a stationary bicycle.
Figure 5:
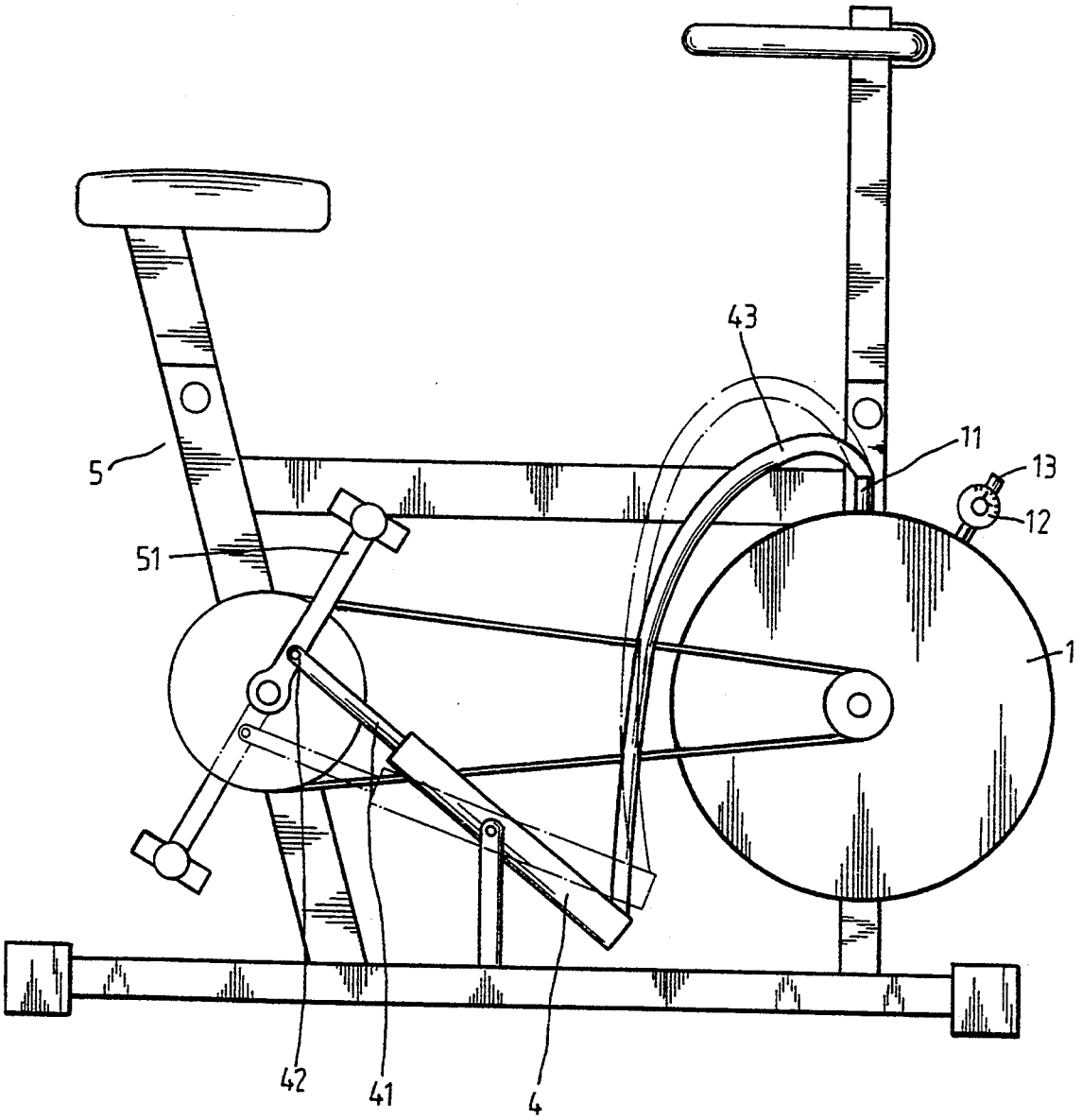
FIG. 5 is a side elevational view showing an air pump connected to one side of a pedal to pump air directly into the pressurized air wheel box.

It is to be noted that the pressure gauge 12 is adjustable to meet different force resistance requirements. The higher the gauge 12 is set, the more pressurized air will be allowed to be pumped internal the box 1 and the more force resistance will be needed to rotate the wheel 2, as shown in FIG. 4. Similarly, when the gauge 12 is adjusted to a lower pressure value, a lower air pressure will be provided in the box i and less force resistance will be encountered to rotate the wheel 2. When pressurized air pumped into the box i through check valve 11 is higher than the pressure gauge 12 readings, the check valve 13 will be activated to release air until the pressurized air in the box 1 is at the level of the pressure gauge 12 setting.

A pump 4 is mounted on a mounting having one end as an input end and includes a displaceable extension of a pedal 51 and having an output end fluidly coupled to the check valve 11 to pump air into the box 1. When a user rotatively displaces the pedal 51, the rod 41 is driven in a reciprocal displacement which continuously pumps air into the box i through the output end of the pump 4 and the check valve 11. When the air in the box I reaches the value setting of the pressure gauge 12, the check valve 13 releases the air in the box 1 until the pressure is commensurate with the setting of the pressure gauge 12.

I claim:

1. An adjustable air pressure force resistance exercise system for a pedal actuated exerciser, comprising:

(a) an enclosed wheel box defining an interior chamber and having a bladed wheel member rotatively mounted therein;

(b) a first check valve mounted to a wall of said wheel box for insert of air into said interior chamber;

(c) a pump mounted to said exerciser having an input end coupled to a pedal of said exerciser, and an output end in fluid communication with said first check valve;

(d) a second check valve mounted to said wall of said wheel box for providing discharge from said interior chamber; and, (e) a pressure gauge connected to said second check valve for opening said second check valve when air pressure within said wheel box reaches a predetermined setting of said pressure gauge.

* * * * *